US006345452B1

(12) United States Patent
Feuilloley et al.

(10) Patent No.: US 6,345,452 B1
(45) Date of Patent: Feb. 12, 2002

(54) METHOD FOR DRYING A HOLLOW BODY AND IMPLEMENTING DEVICE

(75) Inventors: Guy Feuilloley; Véronique Bernard, both of Le Havre Cedex (FR)

(73) Assignee: Sidel S.A., Lehavre Cedex (FR)

( * ) Notice: Subject to any disclaimer, the term of this patent is extended or adjusted under 35 U.S.C. 154(b) by 0 days.

(21) Appl. No.: 09/622,358

(22) PCT Filed: Feb. 4, 1999

(86) PCT No.: PCT/FR99/00252

§ 371 Date: Sep. 15, 2000

§ 102(e) Date: Sep. 15, 2000

(87) PCT Pub. No.: WO99/41558

PCT Pub. Date: Aug. 19, 1999

(30) Foreign Application Priority Data

Feb. 16, 1998 (FR) ..... 98 01938

(51) Int. Cl.[7] ..... F26B 7/00
(52) U.S. Cl. ..... 34/437
(58) Field of Search ..... 34/437, 438, 439, 34/446, 104, 105; 15/304

(56) References Cited

U.S. PATENT DOCUMENTS

| | | | | | |
|---|---|---|---|---|---|
| 1,525,131 | A | | 2/1925 | Hitchcock | |
| 2,140,841 | A | * | 12/1938 | Leonard | 34/18 |
| 2,311,309 | A | | 2/1943 | Bergstrom | |
| 2,548,363 | A | | 4/1951 | Gray | |
| 3,578,297 | A | * | 5/1971 | Niems | 432/80 |
| 3,729,832 | A | * | 5/1973 | Lund | 34/437 |
| 3,755,916 | A | | 9/1973 | Gulaian | |
| 4,691,449 | A | * | 9/1987 | Wiberg | 34/355 |
| 5,249,369 | A | * | 10/1993 | Mallet | 34/437 |
| 5,373,647 | A | * | 12/1994 | Bernes et al. | 34/382 |
| 5,513,446 | A | * | 5/1996 | Neubauer et al. | 34/397 |
| 5,560,122 | A | * | 10/1996 | Bauer et al. | 34/268 |
| 5,673,496 | A | * | 10/1997 | Wegner et al. | 34/471 |
| 6,018,885 | A | * | 2/2000 | Hill | 34/202 |
| 6,192,549 | B1 | * | 2/2001 | Kasen et al. | 15/337 |

FOREIGN PATENT DOCUMENTS

| | | | |
|---|---|---|---|
| DE | 2355910 | * | 5/1975 |
| FR | 340 364 | | 7/1904 |
| FR | 1 245 674 | | 2/1961 |
| GB | 109 715 | | 10/1917 |
| GB | 1 396 565 | | 6/1975 |
| GB | 2 272 273 | | 5/1994 |

* cited by examiner

*Primary Examiner*—Teresa Walberg
*Assistant Examiner*—Daniel Robinson
(74) *Attorney, Agent, or Firm*—Sughrue, Mion, Zinn, Macpeak & Seas, PLLC

(57) ABSTRACT

The invention concerns a method and a device for drying a hollow body (2), such as containers, container preforms, tubes or various conduits. The invention is characterized in that it consists in guiding (9) a drying agent (heat, dessicant, dry air . . . ) towards the assembly of surfaces to be dried, using means enabling said agent to pass entirely over all said surfaces.

12 Claims, 1 Drawing Sheet

METHOD FOR DRYING A HOLLOW BODY AND IMPLEMENTING DEVICE

The invention concerns a procedure for drying a hollow body. It applies particularly but not exclusively to drying containers after they are manufactured and before they are filled, or drying container preforms or blanks during the container manufacturing process. It also concerns a device for implementing the procedure.

As used in this invention, drying is understood to mean a procedure that causes the disappearance of traces of or a small volume of liquid remaining inside or on the walls of a hollow body. Drying is therefore an operation that can follow the draining or emptying of a hollow body after it is cleaned by rinsing or sterilization, requiring the hollow body first to be filled; it can also include the removal of residues or traces of a sterilization agent or any other processing agent that had previously been placed on the inner or outer walls of the hollow body.

Some very special applications of the invention are:

Drying containers that have undergone one of the above-mentioned treatments after they are manufactured and before they are filled, for example cleaning, rinsing, sterilization between the end of the manufacturing line and the beginning of the fill line, or cleaning, rinsing or sterilization after a first usage to prepare for a subsequent use;

Drying plastic (PET, PEN, etc.) container preforms immediately prior to placing them in a sterile machine for manufacturing containers;

Drying tubes or various conduits.

Of course, the examples given above are not restrictive, but are given solely to provide a general idea of the possible field of application of the invention.

The drying procedures and the respective devices known until now are not suitable in this respect because they can not ensure a distribution of the drying agent over the entire inner surface, also called inner wall, of the hollow body, even though it is essentially this surface that should be dried; moreover, the known devices are not "universal" in this respect, because they do not make it possible to process hollow bodies having different shapes, or they are not suitable for processing any type of material.

One known solution for drying hollow bodies consists of heating said bodies in order to evaporate the liquid remaining therein.

This solution is not suitable for drying containers made of heat-sensitive material, such as containers or the preforms thereof made of polymer plastic (PET, PEN, etc.) because the temperature required to bring about the evaporation could cause deterioration (deformation, change of the physical/chemical properties) of the containers.

Moreover, it is not suitable for high-speed processing.

Another solution consists of injecting hot air into the hollow body.

This solution does not allow proper drying to be achieved at a high rate of speed, nor is it suitable for some hollow body shapes.

In fact, proper, quick drying can not be achieved because the injection of hot air causes compression nodes and anti-nodes to appear in the hollow body, resulting in turbulent phenomena that resist a proper sweep and therefore proper drying of the inside of the hollow body. As a result, the flow of hot air must be applied for a long period of time so that all of the surfaces to be dried are swept. This solution is therefore difficult to apply to some types of heat-sensitive materials because some areas are exposed for a significant amount of time to the flow of hot air, which could cause their deterioration.

This solution is not suitable for drying hollow bodies having special shapes, such as bottles and vials.

The hot air flow is injected through the hollow body's opening (the neck) which is small in diameter compared to the other parts of the hollow body. The aforementioned phenomena (compression nodes and anti-nodes) are amplified and it is very difficult to dry the inside of the shoulder of these hollow bodies, i.e., the part that bells out between the neck and the body.

The purpose of the invention, therefore, is a procedure and a device with neither of the above-mentioned disadvantages, that is, they make it possible to: dry the entire surface; use the method without significant modification of the device in the event the hollow body to be dried is changed; apply it to any type of hollow body (bottles, pots, vials, bowls, tubes, etc.); apply it to any type of material.

According to the invention, a procedure for drying hollow bodies, particularly containers or preforms of containers, is characterized by the fact that it consists of causing a gaseous entrainment current that carries a drying agent to all of the surfaces in order to distribute it over all of said surfaces.

Thus by entrainment, that is, by guiding the agent over the surfaces, a proper distribution is obtained, unlike the devices that spray or inject the agent inside. A simple entrainment of the agent after it is inserted makes the process usable with any type of material. As will be explained below, the process can be implemented with a relatively simple device usable for any type of hollow body, regardless of their shape or dimensions, and without the need to modify it significantly when the shape and/or dimensions of the body are changed.

Another advantage is that the entrainment of the agent by a gaseous entrainment current allows the drying to be done regardless of the arrangement of the hollow body, that is, regardless of the position of the opening (up, down or otherwise).

According to another characteristic, the insertion of the agent is brought about outside the hollow body, near its opening, and the entrainment current is produced by causing a suction of the agent by using a suction means acting opposite the opening in the hollow body.

Other characteristics and advantages of the invention will appear in the following description, making reference to the appended figures, in which.

Figure 1:
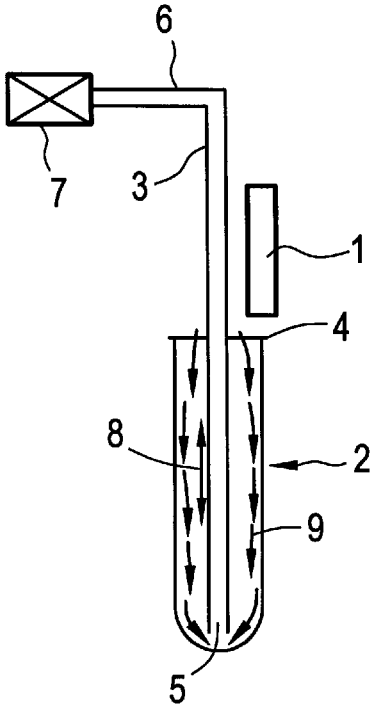
FIG. 1 is a schematic diagram of a device for drying hollow bodies according to the invention.

The device represented in FIG. 1 has a drying agent generator 1.

The drying agent can be a dry or hot gas, such as air, or any other suitable agent (a desiccant, for example).

In one implementation, in which the agent is hot air, the generator 1 is a high temperature hot air generator.

In a preferred implementation, the drying agent is a flame and the generator 1 is then a burner.

Of course, other variations are available to a person skilled in the art, and there is no need for detailing them further.

As illustrated in FIG. 1, the generator 1 is placed outside the hollow body 2 (in this case, a container preform), close to the opening of the latter, and the output of the generator is oriented in such a way that the agent can be directed toward the inside of the hollow body.

According to the example illustrated in FIG. 1 where the hollow body 2 is of the type that is open at only one of its ends (container, container preform, for example), a tube 3 is inserted into the hollow body through its opening 4. One end 5 of the tube is close to an area of the hollow body that is distal from the opening (the bottom area in the case of a container); the other end of the tube is situated outside the container and is connected either directly or by means of a conduit 6 to a source of suction 7.

Preferably, as illustrated in the figure, the longitudinal axis of the tube 3 is aligned with that of the hollow body.

Moreover, the external cross-section of the tube is appreciably smaller than the internal cross-section of the opening of the hollow body so that the drying agent can penetrate the hollow body through the peripheral space remaining between the tube and the opening of the hollow body.

For the placement or removal of the hollow body 2 relative to the device, means are provided that allow a relative axial displacement between the hollow body 2 and at least the tube 3.

Thus, in one implementation, at least the tube 3 slides in the axial direction (double arrow 8) to allow the insertion into or removal from the hollow body 2 relative to the device. In this way the hollow body 2 can be brought to face the device simply by a lateral movement while retracting the tube from the path of travel of the hollow body. Therefore, in order to ensure the placement of the hollow body, known transfer systems can be used, such as gripper transfer mechanisms mounted on articulated arms, or mechanisms with transfer wheels or plates having notches or sockets for guiding the hollow bodies.

Alternatively, it is possible to put the hollow body in place by causing it to move axially while the tube 3 remains fixed.

In one variation, only the tube 3 slides. It slides relative to the hollow body, therefore, and to the generator 1 when the hollow body is being put in place or removed.

In one variation, the tube 3 and the generator 1 are moved axially when the hollow body 2 is put in place or removed.

The opening 4 of the hollow body 2 is placed facing the output of the generator 1, although without coming into contact with it.

Preferably, when the drying takes place during a sterilization process, the device is kept in an environment of pressurized sterile air to prevent additional particles or dust from entering the hollow body to be sterilized. Known means are used to accomplish this, such as an isolation chamber under a laminar flow of sterile air in which the device is installed.

After the device (tube 3, generator 1) and the hollow body 2 have been placed in correct position relative to each other, the drying agent is generated by the generator 1. The suction created by the suction means 7 through the tube 3 that opens (at 5) near the bottom of the hollow body 2 creates an entrainment current for the drying agent which is then directed to the inside of the hollow body (arrows 9) and dries the inner surface of the hollow body.

As has already been mentioned, the drying agent used can be a dry gas, a desiccant, or heat.

The advantage of the suction is that it not only allows the entrainment of the agent over all the walls, but also allows for it to be removed when a desiccant is used.

Preferably, however, the drying is effected by using heat: this is particularly advantageous when the drying occurs during a sterilization process.

In this case, the generator 1 is a heat generator. It can be composed of a high temperature hot air nozzle, or by a burner. The heat or flame is directed toward the opening 4 and simultaneously a suction is created in the hollow body to channel the flame or heat toward the walls.

The use of a flame or hot air generator is not contraindicated for drying hollow bodies made of heat-sensitive materials, such as containers or container preforms made of thermoplastic material.

The reason is that the time of exposure to the heat is very short. Because of the thermal inertia of the material, the directed hot air only acts to sweep or dry the hollow body.

However, when the hollow body to be dried is made of heat-sensitive material, it is preferable to provide means to prevent a direct transfer between the outlet of the heat generator 1 (nozzle or burner) and the hollow body 2.

Figure 2:
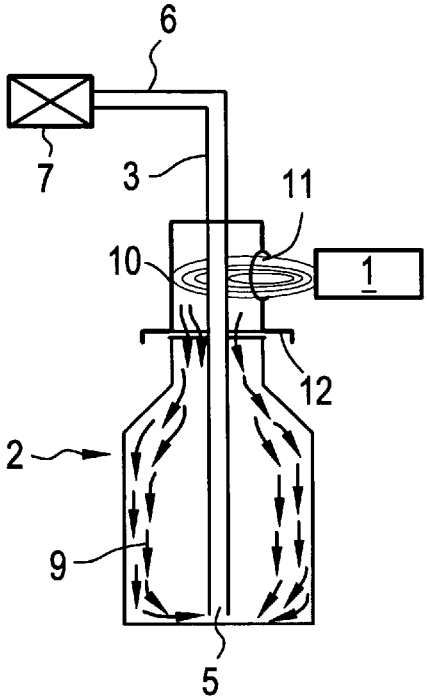
FIG. 2 is a schematic diagram of a preferred device.

FIG. 2 illustrates one possible form of embodiment of a device having means to prevent the direct transfer.

These means include a housing 10 made of heat-resistant material, cylindrical in the example illustrated and open at one of its ends. The open end of the housing 10 faces the opening of the hollow body 2, which in this illustration is a container such as a bottle, without coming into contact therewith in order to prevent deterioration of the hollow body as well as to allow good circulation of the heat. Tests have shown that a gap of between 0.1 mm and 5 mm make it possible to obtain good results.

Moreover, an opening 11 is provided in the wall of the housing 10, and the outlet of the generator 1 is directed toward this opening.

As shown in FIG. 2, the tube 3 is straight and passes through one wall of the housing 10, e.g., the wall opposite the opening facing the hollow body.

In one variation, the tube could have an elbow and pass through the cylindrical wall.

When the device is operating, the heat passes through the housing 10 rather than being sent directly toward the hollow body.

Moreover, the tests performed have demonstrated that the use of a device like the one in FIG. 2 performs better than the one in FIG. 1 where the agent (heat or other) is sent directly toward the hollow body.

The housing 10 actually contributes to causing a directional effect on the agent.

This variation therefore constitutes a preferred form of embodiment.

In addition, when the agent is heat, it is desirable to provide additional means for protecting the opening of the hollow body, such as a plate 12 to protect the opening of the hollow body at least partially enclosing the housing 11 [sic] and placed between the opening 11 through which the hot air or flame passes and the opening of the housing 10 on the side of the hollow body 2, as can be seen in this FIG. 2.

Preferably, as illustrated, the plate is extended by a peripheral flange that more broadly covers the opening of the hollow body.

Preferably, the drying phase of the hollow body is done in two stages. In the first stage, the drying agent (flame, hot air or other) is directed toward the hollow body, with the suction active; in the second, the suction continues while the agent is no longer applied, in such a way that all residues of wetting agent and other agent, whether it be gas, heat or desiccant, are evacuated.

By way of example, the drying of container preforms made of thermoplastic material is achieved by applying a flame for 1 to 3 seconds to the opening 11 and by continuing the suction for between 2 and 6 seconds.

Figure 3:
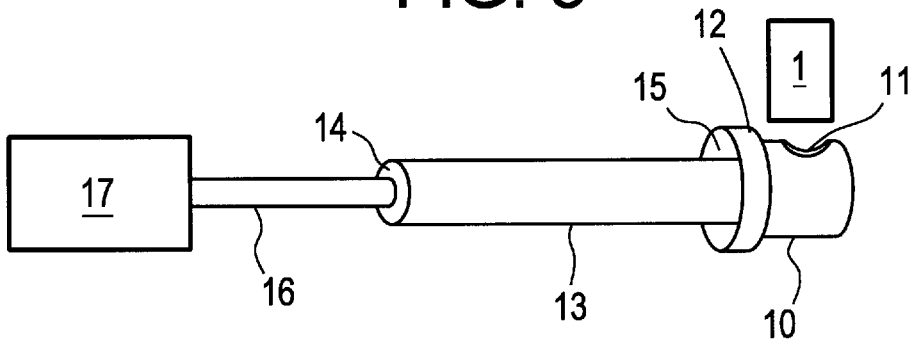
FIG. 3 is a diagram of a variation of the devices in FIGS. 1 and 2, applicable for drying tubes or conduits.

FIG. 3 shows a schematic diagram of the invention when it is used to dry hollow bodies that are open at both ends, e.g., tubes or various conduits.

In this case, the suction is not achieved through a tube passing through the hollow body 13 and opening out at the end 14 of the hollow body opposite to the end 15 near the generator 1, and preferably the housing 10, 11, 12, as shown:

it is achieved through a tube 16 situated at the open end 14 of the hollow body opposite to the end 13 near the generator 1 and the housing 10. The tube 16 is connected to the suction means 17.

The devices described in FIGS. 1, 2, 3 can be part of a more extensive processing facility. For example, they can be downstream or upstream from a machine that manufactures hollow bodies such as tubes or containers that need to be dried, for example following a cleaning or sterilization operation, or hollow bodies after they are manufactured, either preforms or hollow body blanks prior to manufacture.

They can also be placed upstream of filling facilities, or manufacturing/filling facilities, when the hollow bodies are containers.

Obviously the invention is not limited only to the forms of embodiment and application described. It encompasses all possible equivalent and variations of embodiment or application.

What is claimed is:

1. Procedure for drying hollow bodies (9) having at least one opening, of the type consisting of placing a flame injected by a burner in contact with the surfaces to be dried, characterized by the fact that it consists of injecting the flame outside the hollow body near said opening, and using suction means acting inside the hollow body in an area distal from said opening, to cause a gaseous current to entrain the flame toward the inside of the hollow body in order to distribute it over all of the surfaces to be dried.

2. Procedure according to claim 1, characterized by the fact that the drying involves two stages: a first stage in which the flame is directed toward the hollow body, the suction being active, and a second in which the suction continues while the flame is no longer applied.

3. Procedure according to claim 2, characterized by the fact that the flame is applied for 1 to 3 seconds.

4. Procedure according to claim 2, characterized by the fact that the suction continues for 2 to 6 seconds.

5. Device for implementing the procedure according to claim 1, characterized by the fact that it has means (1) for generating a flame outside the hollow body, means (3, 6, 7; 16, 17) for causing a gaseous current to entrain flame to the inner surfaces of a hollow body (2; 13) while the latter is in position relative to the device, said means for causing the gaseous current being composed of suction means acting inside the hollow body in an area distal from said opening.

6. Device according to claim 5, characterized by the fact that it has a housing (10) placed outside the hollow body (2; 13) near the opening thereof, and provided:

with an opening (11) that faces the outlet of the means (1) of generating the drying agent; one open end having a shape and inside dimensions that correspond appreciably with those of the inside opening of the hollow body.

7. Device according to claim 5, characterized by the fact that the means for causing the gaseous current are composed of a tube (3; 16) connected to a source of suction (7; 17).

8. Device according to claim 7, characterized by the fact that when the hollow body is in the form of a container, that is, open at one of its ends and closed at the other, the tube (3) is inserted through the opening of the hollow body; the tube has one end that opens near the bottom of the hollow body, and its other end, outside the hollow body, is connected to th e source of suction (7).

9. Device according to claim 8, characterized by the fact that the tube (3) passes through one wall of the housing (10).

10. Device according to claim 7, characterized by the fact that when the hollow body (13) is a tube or conduit open at two opposite ends, the suction is effected by placing the suction tube (16) at the end (14) of the hollow body opposite to the end (15) where the drying agent is injected.

11. Device according to claim 5, characterized by the fact that it is situated in a laminar flow of sterile gas, such as air.

12. Hollow body manufacturing and/or filling facility, characterized by the fact that it has a device according to claim 5.

* * * * *